US010113474B2

(12) United States Patent
Shikata

(10) Patent No.: US 10,113,474 B2
(45) Date of Patent: Oct. 30, 2018

(54) COOLING DEVICE FOR INTERNAL COMBUSTION ENGINE

(71) Applicant: DENSO CORPORATION, Kariya, Aichi-pref. (JP)

(72) Inventor: Yasuhiro Shikata, Kariya (JP)

(73) Assignee: DENSO CORPORATION, Kariya (JP)

( * ) Notice: Subject to any disclaimer, the term of this patent is extended or adjusted under 35 U.S.C. 154(b) by 137 days.

(21) Appl. No.: 15/117,307

(22) PCT Filed: Feb. 4, 2015

(86) PCT No.: PCT/JP2015/000496
§ 371 (c)(1),
(2) Date: Aug. 8, 2016

(87) PCT Pub. No.: WO2015/125428
PCT Pub. Date: Aug. 27, 2015

(65) Prior Publication Data

US 2016/0341101 A1 Nov. 24, 2016

(30) Foreign Application Priority Data

Feb. 24, 2014 (JP) ..... 2014-033434

(51) Int. Cl.
*F01P 7/16* (2006.01)
*F01P 7/14* (2006.01)

(52) U.S. Cl.
CPC ..... *F01P 7/165* (2013.01); *F01P 7/16* (2013.01); *F01P 2007/146* (2013.01); *F01P 2025/32* (2013.01); *F01P 2037/02* (2013.01)

(58) Field of Classification Search
CPC ..... F01P 7/165; F01P 7/16; F01P 2007/146; F01P 2025/32; F01P 2037/02
(Continued)

(56) References Cited

U.S. PATENT DOCUMENTS

2010/0262301 A1* 10/2010 Schwartz ..... B60K 6/405 700/282
2012/0199084 A1 8/2012 Kinomura
(Continued)

FOREIGN PATENT DOCUMENTS

JP 2011-214566 10/2011
JP WO 2011/148464 12/2011

*Primary Examiner* — Joseph Dallo
*Assistant Examiner* — Yi-Kai Wang
(74) *Attorney, Agent, or Firm* — Nixon & Vanderhye PC

(57) ABSTRACT

A cooling device for an internal combustion engine has an outflow temperature sensor, a flow control valve, and a control device. The outflow temperature sensor detects an outflow temperature of the cooling water flowing out from a cooling-water outlet of the internal combustion engine. The flow control valve adjusts a flow rate of the cooling water flowing in a bypass passage. The control device controls the flow control valve to be open or closed. The control device, during a warming of the internal combustion engine, controls the flow control valve to be open or closed based on information about a change rate of the outflow temperature to prevent the change rate of the outflow temperature from decreasing to a minus value, after opening the flow control valve and starting a circulation of the cooling water in a route passing through the bypass passage.

5 Claims, 3 Drawing Sheets

(58) Field of Classification Search
USPC ..... 123/41.1
See application file for complete search history.

(56) References Cited

U.S. PATENT DOCUMENTS

2015/0192338 A1* 7/2015 Knatt ..... F25C 1/00
62/66
2015/0202571 A1* 7/2015 Cho ..... F23J 13/00
422/109
2015/0233337 A1* 8/2015 Shutty ..... F02N 19/10
123/41.1
2016/0265458 A1* 9/2016 Okada ..... F02D 41/0065

* cited by examiner

COOLING DEVICE FOR INTERNAL COMBUSTION ENGINE

CROSS REFERENCE TO RELATED APPLICATION

This application is the U.S. national phase of International Application No. PCT/JP2015/000496 filed Feb. 4, 2015 which designated the U.S. and claims priority to Japanese Patent Application No. 2014-033434 filed on Feb. 24, 2014, entire contents of each of which are hereby incorporated herein by reference.

TECHNICAL FIELD

The present disclosure relates to a cooling device for an internal combustion engine, which includes a bypass passage that circulates cooling water for the internal combustion engine without passing the cooling water through a radiator.

BACKGROUND ART

As a cooling device for an internal combustion engine, there is a cooling device including an external passage (i.e., bypass passage) that circulates the cooling water for the internal combustion engine without passing the cooling water through a radiator, to accelerate warming of the internal combustion engine. There is another cooling device which accelerates warming of an internal combustion engine by stopping a circulation of the cooling water during a warming of the internal combustion engine.

However, according to investigations, the inventors of the application found that there is a possibility that the temperature, which previously increased before starting the circulation of the cooling water, of the internal combustion engine is temporarily decreased because low-temperature cooling water flows into the internal combustion engine when the circulation of the cooling water is started from a stopped state of the circulation of the cooling water during a warming of an internal combustion engine.

A countermeasure against the temporary temperature decrease of the internal combustion engine is described in Patent Literature 1 (JP 2011-214566 A), for example. According to Patent Literature 1, when the circulation of the cooling water is started, the opening degree of a flow adjustment valve is controlled such that the lower the temperature of the cooling water flowing into an internal combustion engine (i.e., inflow temperature), the lower the flow rate of the cooling water, and the higher the temperature of the cooling water flowing out of the internal combustion engine (i.e., outflow temperature), the higher the flow rate of the cooling water.

PRIOR ART LITERATURES

Patent Literature

Patent Literature 1: JP 2011-214566 A

SUMMARY OF INVENTION

However, according to the above-described technique disclosed in Patent Literature 1, the opening degree of the flow adjustment valve is merely controlled based on inflow temperature or outflow temperature, and the behavior of the outflow temperature (e.g., the change rate) that changes with the temperature of the internal combustion engine is not considered. Therefore, a temperature decrease of the internal combustion engine after starting the circulation of the cooling water may not be restricted effectively.

In view of the foregoing circumstances, an object of the present disclosure is to provide a cooling device for an internal combustion engine, which is effectively able to restrict temperature decrease of the internal combustion engine after starting the circulation of the cooling water.

A cooling device for an internal combustion engine includes a bypass passage that circulates cooling water for cooling the internal combustion engine to bypass a radiator. The cooling device has an outflow temperature sensor, a flow control valve, and a control device. The outflow temperature sensor detects an outflow temperature of the cooling water flowing out from a cooling-water outlet of the internal combustion engine. The flow control valve adjusts a flow rate of the cooling water flowing in the bypass passage. The control device controls the flow control valve to be open or closed. The control device, during a warming of the internal combustion engine, controls the flow control valve to be open or closed based on information about a change rate of the outflow temperature to prevent the change rate of the outflow temperature from decreasing to a minus value, after opening the flow control valve and starting a circulation of the cooling water in a route passing through the bypass passage.

Since the outflow temperature changes with the temperature of the internal combustion engine, the information about the change rate of the outflow temperature is monitored, and the flow control valve is controlled to be open or closed so as to prevent the change rate of outflow temperature from decreasing to a minus value. Accordingly, the direction in which the temperature of the internal combustion engine changes is restricted from being a minus direction (i.e., a decrease direction). Thus, a temperature decrease of the internal combustion engine after starting the circulation of the cooling water can effectively be prevented.

DESCRIPTION OF EMBODIMENTS

An embodiment of the present disclosure will be described herein after.

Figure 1:
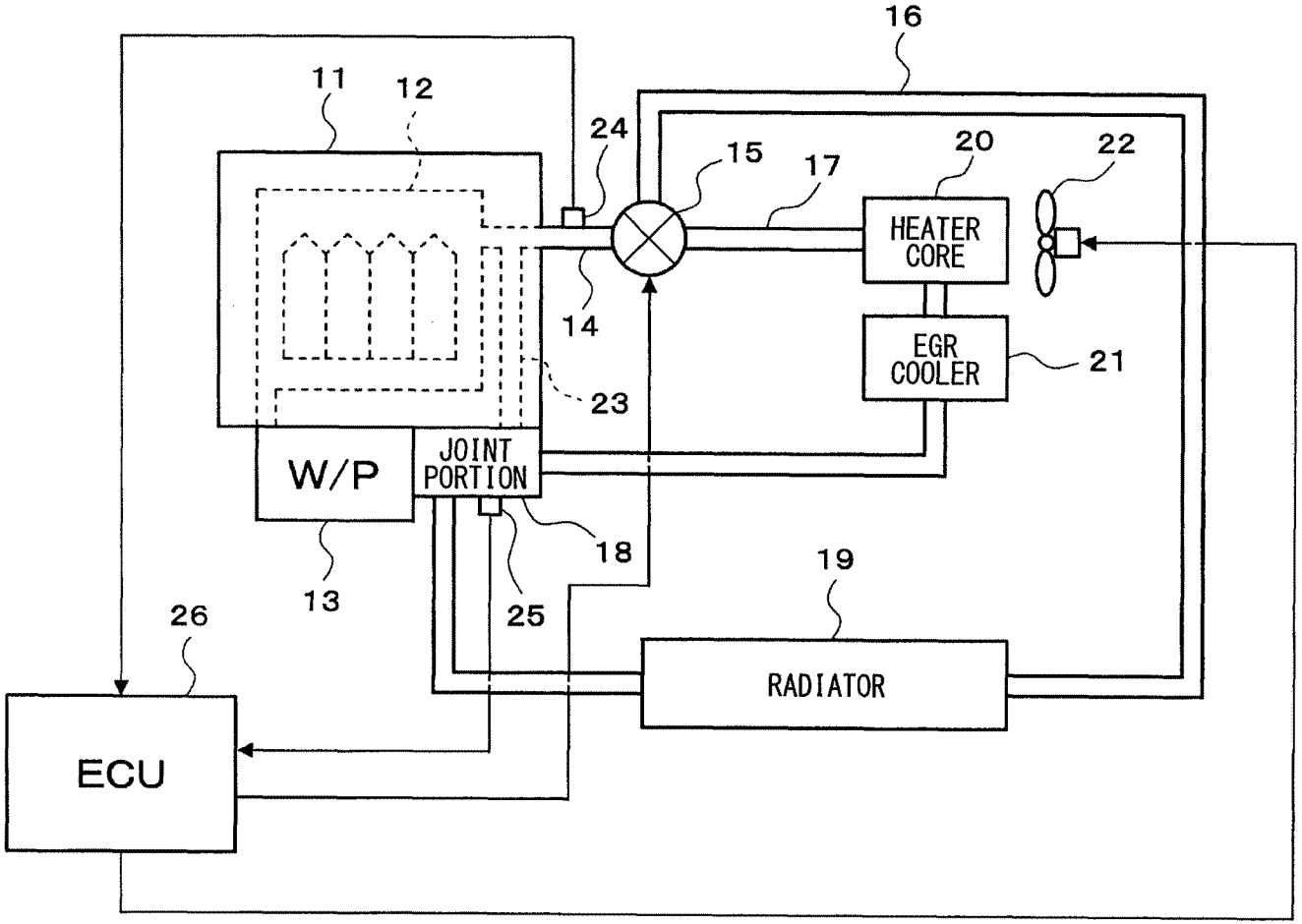
FIG. 1 is a diagram illustrating a schematic configuration of an engine cooling system according to an embodiment of the present disclosure.

First, a schematic configuration of an engine cooling system will be described with reference to FIG. 1.

A water pump 13 for circulating cooling water is provided near an inlet of a water jacket 12 (i.e., cooling water passage) of an engine 11, which is an internal combustion engine. The water pump 13 is a mechanical pump driven by power from the engine 11.

An outlet passage 14 is connected to an outlet of the water jacket 12 of the engine 11. Connected to the outlet passage 14 are a radiator passage 16 and a bypass passage 17 via a flow control valve 15. The radiator passage 16 is a passage that circulates the cooling water for the engine 11 through a radiator 19. The bypass passage 17 is a passage that circulates the cooling water for the engine 11 to bypass the radiator 19.

The radiator passage 16 and the bypass passage 17 are connected to a suction port of the water pump 13 via a joint portion 18. The radiator passage 16 is provided with the radiator 19 that dissipates heat of the cooling water. The bypass passage 17 is provided with a heater core 20 for heating, and an EGR cooler 21 for cooling EGR gas. Near the heater core 20, a heater blower 22 is disposed for sending out a stream of hot air. The outlet of the water jacket 12 and the joint portion 18 are connected by another bypass passage 23.

When the flow control valve 15 is closed, a circulation of the cooling water toward the bypass passage 17 and toward the radiator passage 16 is stopped. On the other hand, when the flow control valve 15 is opened and the opening degree of the valve falls in a first range where the degree is equal to or lower than a specified value, the cooling water is distributed to the bypass passage 17 while the flow of the cooling water to the radiator passage 16 is blocked off. Consequently, the cooling water circulates in a route passing through, in the following order, the water jacket 12, the outlet passage 14, the bypass passage 17 (the heater core 20, the EGR cooler 21), the joint portion 18, the water pump 13, and the water jacket 12. Conversely, when the opening degree of the flow control valve 15 falls in a second range where the degree is equal to or higher than the specified value, the cooling water is distributed to the radiator passage 16. Consequently, the cooling water circulates also sequentially in a route passing through, in the following order, the water jacket 12, the outlet passage 14, the radiator passage 16 (the radiator 19), the joint portion 18, the water pump 13, and the water jacket 12.

The outlet passage 14 is provided with an outflow temperature sensor 24 that detects the temperature of the cooling water flowing out from the cooling-water outlet of the engine 11 (hereinafter, referred to as the outflow temperature Twout). The joint portion 18 is provided with an inflow temperature sensor 25 that detects the temperature of the cooling water flowing in from the cooling-water inlet of the engine 11 (hereinafter, referred to as the inflow temperature).

Outputs from these various sensors are input to an electronic control unit (i.e., ECU) 26. The ECU 26 is configured by a microcomputer as a main body and performs various engine control programs stored in an incorporated ROM (i.e., storage medium). Specifically, the ECU 26 controls, depending on the running state of the engine, fuel injection quantity, ignition timing, throttle opening degree (i.e., intake air volume), and so on.

In addition, the ECU 26 closes the flow control valve 15 during a warming of the engine 11 and stops the circulation of the cooling water, thereby accelerating the warming of the engine 11. Subsequently, the flow control valve 15 is opened in the first range to start the circulation of the cooling water in the route passing through the bypass passage 17, when the outflow temperature Twout detected by the outflow temperature sensor 24 becomes equal to or higher than the specified temperature T1 (e.g., 40° C.).

Figure 2:
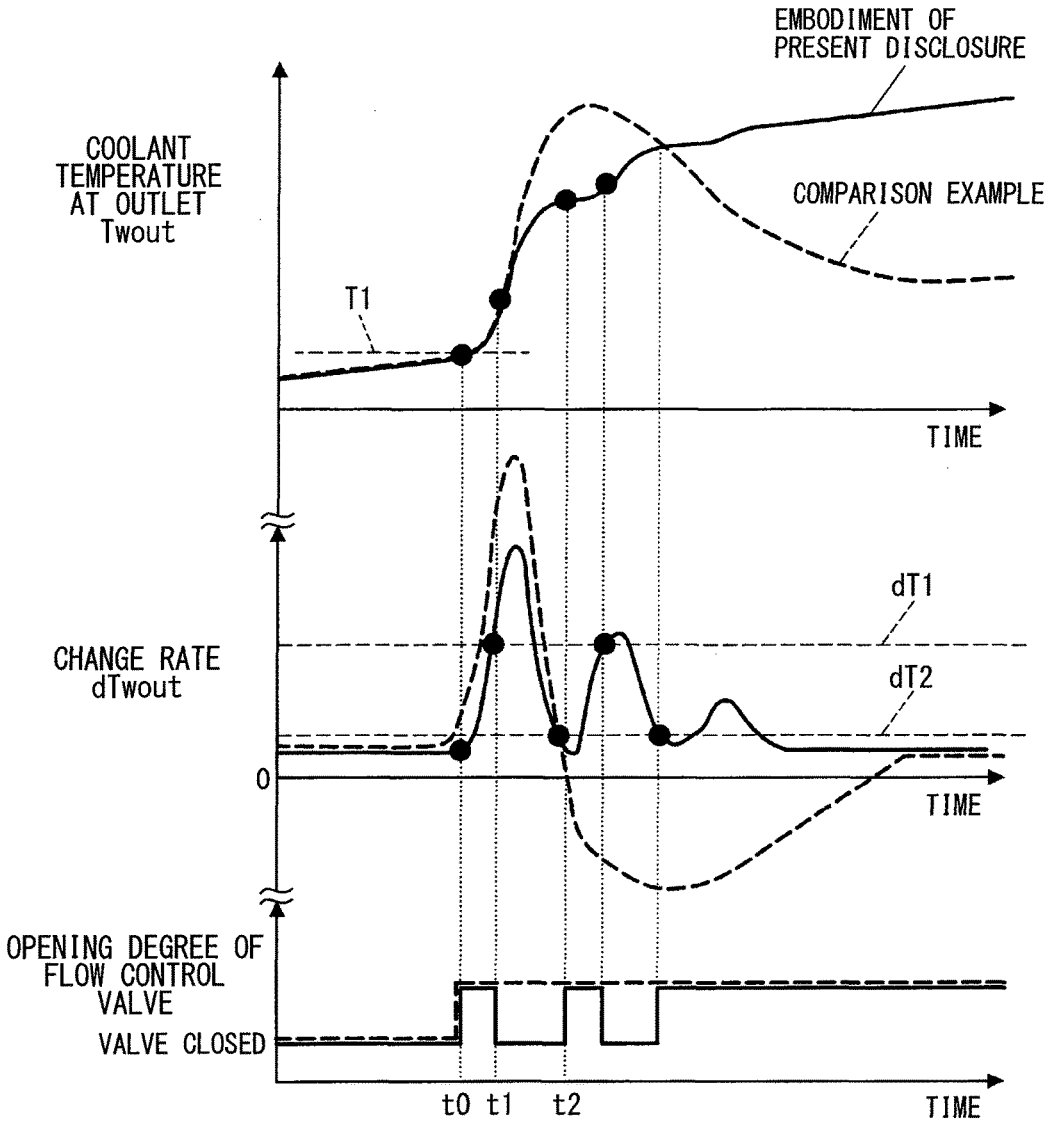
FIG. 2 is a time chart showing a performance example of an open/close control routine.

In this case, as shown in a comparison example indicated by the broken line in FIG. 2, a low-temperature cooling water flows into the engine 11 after cooling water warmed in the engine 11 flows out of the engine 11, by maintaining the flow control valve 15 to be opened after starting the circulation of the cooling water. Accordingly, the temperature of the engine 11 that is previously increased before starting the circulation of the cooling water may temporarily decrease. In this case, the temperature of the engine 11 decreases after the outflow temperature Twout suddenly increases.

According to the present embodiment, the ECU 26 performs the following controls by performing an open/close control routine (described below) shown in FIG. 3, such that a temperature decrease of the engine 11 after starting the circulation of the cooling water is restricted. The flow control valve 15 is controlled to be open or closed based on information about a change rate of the outflow temperature Twout, after opening the flow control valve 15 in the first range to start the circulation of the cooling water in the rout passing through the bypass passage 17 during the warming of the engine 11. Specifically, according to the present embodiment, the flow control valve 15 is controlled to be open or closed to prevent the change rate dTwout from decreasing to a minus value, by using the change rate dTwout as the information about the change rate of the outflow temperature Twout. It should be noted that the information about change rate of the outflow temperature Twout is not limited to the change rate dTwout of the outflow temperature Tout, but may be information having a correlation with the change rate dTwout. Since the outflow temperature Twout changes with the temperature of the engine 11, the change rate dTwout is monitored, and the opening or closing of the flow control valve 15 is controlled so as to prevent the change rate dTwout from decreasing to a minus value. Accordingly, a direction in which the temperature of the engine 11 changes is prevented from being a minus direction (i.e., a decrease direction).

Specifically, as indicated by the solid line in FIG. 2 the flow control valve 15 is opened in the first range to start the circulation of the cooling water in the route passing through the bypass passage 17, at a time point t0 at which the oufflow temperature Twout detected by the oufflow temperature sensor 24 becomes equal to or higher than the specified temperature T1 during the warming of the engine 11. Subsequently, the open/close control routine is performed to repeat (i) closing the flow control valve 15 at a time point t1 where the change rate dTwout of the outflow temperature Twout becomes equal to or higher than a first threshold value dT1 and (ii) opening the flow control valve 15 at a time point t2 where the change rate dTwout becomes equal to or lower than a second threshold value dT2. Here, both the first and second threshold values dT1 and dT2 are set at values larger than 0. The second threshold value dT2 is set at a value smaller than the first threshold value dT1 (dT1>dT2>0).

Subsequently, the open/close control routine is completed and proceeds to an opening-degree control in which the opening degree of the flow control valve 15 is controlled based on a deviation of the oufflow temperature Twout from a target oufflow temperature, when a condition that the change rate dTwout is equal to or lower than a specified value dT3 is continued for a specified period P or longer while the flow control valve 15 is being opened. Here, the specified value dT3 is set at, for example, a value equal to or smaller than the second threshold value dT2 (dT2≥dT3>0).

Next, the content of the process of the open/close control routine in FIG. 3 executed by the ECU 26 according to the present embodiment will be described.

Figure 3:
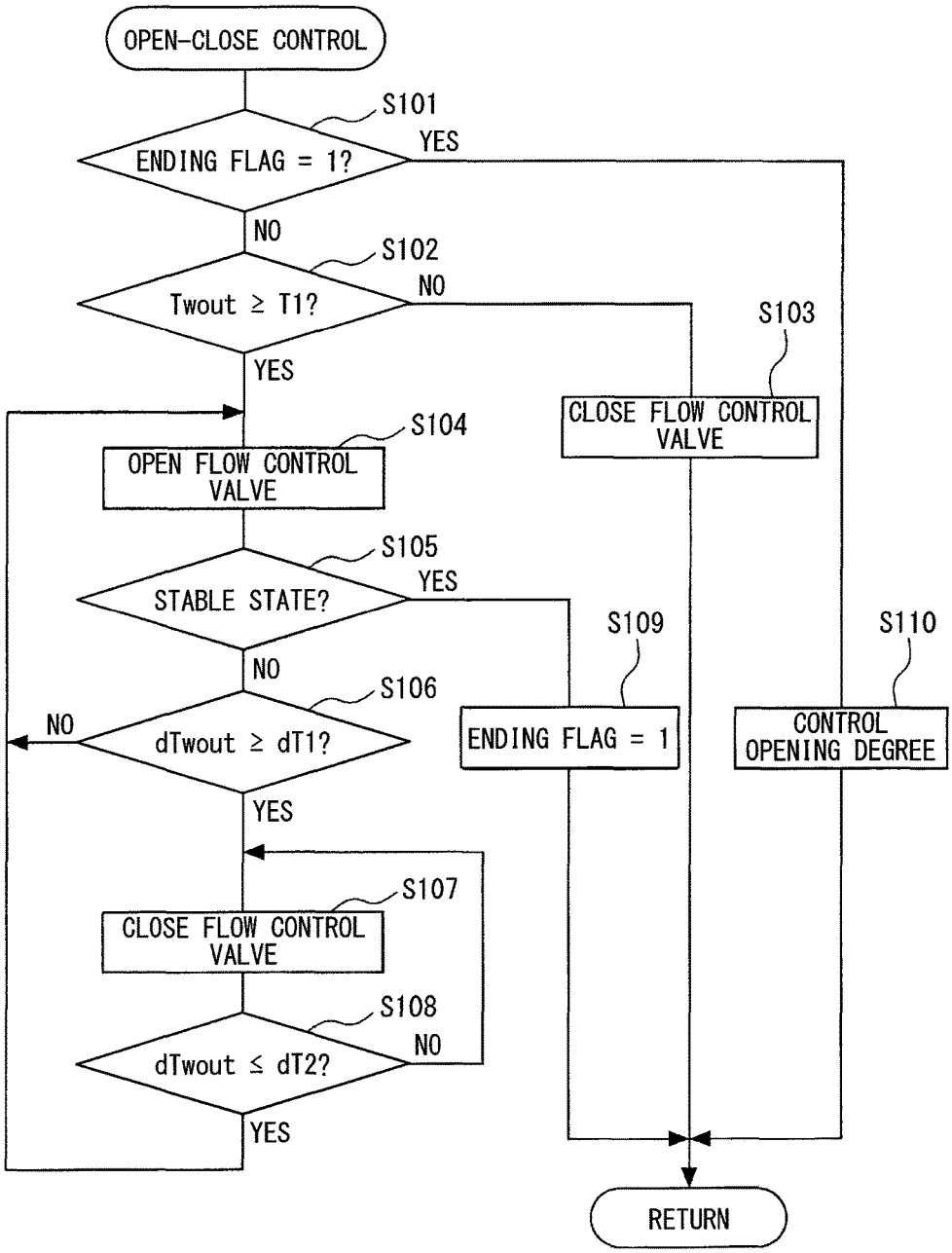
FIG. 3 is a flowchart showing a flow of the process of the open/close control routine.

The open/close control routine shown in FIG. 3 is repeated at a specified cycle during the warming of the engine 11 and functions as a control device. The expression "during the warming of the engine 11" means the period required for, for example, the outflow temperature Twout or the inflow temperature to exceed a specified warming-completion determination value.

It is determined whether an ending flag is set at "1" that indicates an end of the open/close control routine at S101 when the open/close control routine is started.

The open/close control routine proceeds to S102 when the ending flag is determined to be "0" at S101, and it is determined whether the outflow temperature Twout detected by the outflow temperature sensor 24 is equal to or higher than a specified temperature T1 (e.g., 40° C.).

The open/close control routine proceeds to S103 when the outflow temperature Twout is determined to be lower than the specified temperature T1 at S102, and the flow control valve 15 is maintained to be closed, and the circulation of the cooling water is also maintained to be stopped.

The open/close control routine proceeds to S104 when the outflow temperature Twout is determined to be equal to or higher than the specified temperature T1 at S102, and the flow control valve 15 is opened in the first range to start the circulation of the cooling water in the route passing through the bypass passage 17.

In this case, the opening degree of the flow control valve 15 (i.e., the opening degree of the valve when opened) is set using a map, an expression, or the like depending on the integrated flow rate of the cooling water. The map, an expression or the like for the opening degree of the flow control valve 15 is set such that the lower the integrated flow rate of the cooling water, the lower the opening degree of the flow control valve 15.

The flow rate of the cooling water can be obtained on the basis of the opening degree of the flow control valve 15 and the rotation speed of the engine 11 (i.e., the rotation speed of the water pump 13). In addition, by integrating the flow rate of the cooling water, the integrated flow rate of the cooling water can be obtained.

Subsequently, the routine proceeds to S105, and it is determined whether a change of the outflow temperature Twout is stable or not based on a determination whether the condition that the change rate dTwout of the outflow temperature Twout is equal to or lower than the specified value dT3 is already continued for a specified period P or longer. The expression "the change of outflow temperature Tout is stable" means that, for example, the outflow temperature Twout increases relatively gradually.

In this case, the specified period P is set using a map, an expression or the like depending on the flow rate of the cooling water. Thus, the specified period P is set to, for example, a time slightly longer than the period of the circulation of the cooling water. The circulation cycle is the time required for cooling water to make one rotation of the circulation route passing through the bypass passage 17. A map, an expression or the like for the specified period P is set to shorten the specified period P in response to the period of the circulation of the cooling water that is shortened as the flow rate of the cooling water increases.

The open/close control routine proceeds to S106 when the change of the outflow temperature Twout is determined not to be stable and determines whether the change rate dTwout is equal to or higher than the first threshold value dT1.

In this case, the first threshold value dT1 is set using a map, an expression or the like depending on the integrated flow rate of the cooling water. The map, numerical value, or the like for the first threshold value dT1 is set such that the lower the integrated flow rate of the cooling water, the smaller the first threshold value dT1, thereby narrowing the variation range of the change rate dTwout. The variation range of the change rate dTwout means a range from the second threshold value dT2 to the first threshold value dT1. The first threshold value dT1 may be set at a fixed value in advance, and only the second threshold value dT2 may be set depending on the integrated flow rate of the cooling water.

The open/close control routine returns to S104 when the change rate dTwout is determined to be smaller than the first threshold value dT1 at S106, and the flow control valve 15 is maintained to be open.

The open/close control routine proceeds to S107 when the change rate dTwout is determined to be equal to or higher than the first threshold value dT1 at S106, and the flow control valve 15 is closed to temporarily stop the circulation of the cooling water.

Subsequently, the open/close control routine proceeds to S108 and determines whether the change rate dTwout is equal to or lower than the second threshold value dT2.

In this case, the second threshold value dT2 is set using a map, an expression or the like depending on the integrated flow rate of the cooling water. The map, numerical value, or the like for the second threshold value dT2 is set such that the lower the integrated flow rate of the cooling water, the larger the second threshold value dT2, thereby narrowing the variation range of the change rate dTwout. The second threshold value dT2 may be set at a fixed value in advance, and only the first threshold value dT1 may be set depending on the integrated flow rate of the cooling water.

The open/close control routine returns to S107 when the change rate dTwout is determined to be higher than the second threshold value dT2 at S108, and the flow control valve 15 is maintained to be closed.

The open/close control routine proceeds to S104 when the change rate dTwout is determined to be equal to or lower than the second threshold value dT2 at S108, and the flow control valve 15 is opened to circulate the cooling water in the route passing through the bypass passage 17.

Through the processes S104 to S108, the open/close control routine is performed to repeat (i) closing the flow control valve 15 every time the change rate dTwout becomes equal to or higher than the first threshold value dT1 and (ii) opening the flow control valve 15 every time the change rate dTwout becomes equal to or lower than the second threshold value dT2.

Subsequently, the open/close control routine is completed when the change of the outflow temperature Twout is determined to be stable at S105, and the open/close control routine proceeds to S109 and sets the ending flag at "1". Consequently, it is determined that the ending flag is "1" at S101, and the open/close control routine proceeds to S110 to shift to opening-degree control.

In the opening-degree control, the opening degree of the flow control valve 15 is controlled based on a deviation of the outflow temperature Twout from the target outflow temperature.

According to the above-described embodiment, during the warming of the engine 11, the flow control valve 15 is opened, and the circulation of the cooling water is started in the route passing through the bypass passage 17. Subsequently, the flow control valve 15 is controlled to be open or closed based on the change rate dTwout of the outflow temperature Twout so as to prevent the change rate dTwout from decreasing to a minus value. Since the outflow temperature Twout changes with the temperature of the engine 11, the change rate dTwout is monitored and opening or closing of the flow control valve 15 is controlled so as to prevent the change rate dTwout from decreasing to a minus value. As a result, the direction in which the temperature of the engine 11 changes is restricted from becoming a minus direction (i.e., the decrease direction). Thus, the temperature decrease of the internal combustion engine 11 after starting the circulation of the cooling water can effectively be prevented.

In this case, in the open/close control routine according to the present embodiment, the flow control valve 15 is opened to starts the circulation of the cooling water in the route passing through the bypass passage 17 when the outflow temperature Twout reaches a temperature that is equal to or higher than the specified temperature T1 during the warming of the engine 11. Subsequently, the flow control valve 15 is closed when the change rate dTwout reaches a value that is equal to or higher than the first threshold value dT1. The flow control valve 15 is opened when the change rate dTwout reaches a value that is equal to or lower than the second threshold value dT2. In the open/close control routine, the above-described process is repeated. Thus, the change rate dTwout of the outflow temperature Twout is maintained near a specified variation range by the open/close control routine. Accordingly, while the change rate dTwout is restricted from decreasing to a minus value, the outflow temperature Twout can be increased at a suitable rate.

In addition, according to the present embodiment, the first threshold value dT1 and the second threshold value dT2 are set depending on the integrated flow rate of the cooling water when the open/close control routine is performed. Thus, the variation range of the change rate dTwout can appropriately be changed by changing the first threshold value dT1 and the second threshold value dT2 depending on the integrated flow rate of the cooling water. For example, when the integrated flow rate of the cooling water is lower, the variation in the change rate dTwout tends to be larger. Therefore, each of the first and second threshold values dT1, dT2 is set such that the lower the integrated flow rate of the cooling water, the narrower the variation range of the change rate dTwout, that is, a range from the second threshold value dT2 to the first threshold value dT1. Thus, variation in the change rate dTwout of the outflow temperature Twout can be restricted.

In addition, according to the present embodiment, the opening degree of the flow control valve 15 is set depending on the integrated flow rate of the cooling water when the opening/control is performed. Thus, the flow rate of the cooling water while the flow control valve 15 is being opened can appropriately be changed by changing the opening degree of the flow control valve 15 depending on the integrated flow rate of the cooling water. For example, when the integrated flow rate of the cooling water is lower, the variation in the change rate dTwout tends to be larger. Therefore, the lower the integrated flow rate of the cooling water is, the lower the opening degree of the flow control valve 15 becomes. Accordingly, the flow rate of the cooling water is decreased to restrict variation in the change rate dTwout.

According to the present embodiment, it is determined that the change of the outflow temperature Twout is stable when the condition that the change rate dTwout is equal to or lower than the specified value dT3 is continued for the specified period P or longer while the flow control valve 15 is being opened. Therefore, the open/close control routine is completed and proceeds to the opening-degree control. Accordingly, the open/close control routine is completed immediately and proceeds to the opening-degree control, when the change of the outflow temperature Twout becomes stable.

According to the present embodiment, the specified period P is set depending on the flow rate of the cooling water. The specified period P is changed with the change of cycle of the circulation of the cooling water depending on the flow rate of the cooling water. Accordingly, the specified period P can be set at an appropriate value, for example, a time slightly longer than the period of the circulation of the cooling water.

According to the present embodiment, the change rate dTwout of the outflow temperature Twout is used as the information about change rate of the outflow temperature Twout, and the flow control valve 15 is controlled to be open or closed so as to prevent the change rate dTwout from decreasing to a minus value. However, the information about the change rate of the outflow temperature Twout may be, for example, a degree of change of the outflow temperature Twout per specified time or may be the time required for the outflow temperature Twout to change only by a specified value. In this case, the flow control valve 15 is also controlled to be open or closed so as to prevent the change rate dTwout from decreasing to a minus value.

In addition, according to the present embodiment, the first threshold value dT1 and the second threshold value dT2 are set depending on the integrated flow rate of the cooling water. However, each of the first and second threshold values dT1, dT2 may be a fixed value set in advance.

In addition, according to the present embodiment, the opening degree of the flow control valve 15 is set depending on the integrated flow rate of the cooling water. However, the opening degree of the flow control valve 15 may be a fixed value set in advance.

According to the present embodiment, the specified period P is set depending on the flow rate of the cooling water. However the specified period P may be a fixed value set in advance.

According to the above-described embodiment, the flow control valve 15 is switched between an open state and a closed state by comparing the information about the change rate of the outflow temperature Twout (i.e., the change rate dTwout) with the two threshold values (i.e., first threshold value dT1 and second threshold value dT). However, the invention is not limited to the above example. The flow control valve 15 may be switched between an open state and a closed state by comparing the information about the change rate of the outflow temperature Twout with one threshold value or three or more threshold values.

According to the above-described embodiment, the flow rate of the cooling water in the bypass passage and the flow rate of the cooling water in the radiator passage are adjusted using only one flow control valve 15. However, for example, a flow control valve for adjusting the flow rate of the cooling water in the bypass passage and a flow control valve for adjusting the flow rate of the cooling water in the radiator passage may separately be provided. In addition, a thermostat, which is opened/closed depending on the temperature of the cooling water, may be provided.

According to the above-described embodiment, the mechanical water pump, which is driven by power from the engine, is provided. However, an electric water pump, which is driven by a motor, may be provided.

According to the present disclosure, the configuration of the engine cooling system, such as a connection method for the bypass passage and the radiator passage, the positions of the flow control valve and water temperature sensor may be altered as required.

Thus, the present disclosure can be variously changed within a scope of the present disclosure.

The invention claimed is:

1. A cooling device for an internal combustion engine, the cooling device including a bypass passage that circulates cooling water for cooling the internal combustion engine to bypass a radiator, the cooling device comprising:

an outflow temperature sensor that detects an outflow temperature of the cooling water flowing out from a cooling-water outlet of the internal combustion engine;

a flow control valve that adjusts a flow rate of the cooling water flowing in the bypass passage; and a control device that controls the flow control valve to be open or closed, wherein the control device, during a warming of the internal combustion engine, controls the flow control valve to be open or closed based on information about a change rate of the outflow temperature to prevent the change rate of the outflow temperature from decreasing to a minus value, after opening the flow control valve and starting a circulation of the cooling water in a route passing through the bypass passage, the control device opens the flow control valve to start the circulation of the cooling water in the route passing through the bypass passage when the outflow temperature becomes equal to or higher than a specified value during the warming of the internal combustion engine, and the control device performs an open/close control routine to repeat:

closing the flow control valve when the information about the change rate of the outflow temperature becomes equal to or higher than a first threshold value; and opening the flow control valve when the information about the change rate of the outflow temperature becomes equal to or lower than a second threshold value that is smaller than the first threshold value.

2. The cooling device for the internal combustion engine according to claim 1, wherein the control device sets, in the open/close control routine, at least one of the first threshold value and the second threshold value depending on an integrated flow rate of the cooling water.

3. The cooling device for the internal combustion engine according to claim 1, wherein the control device sets, in the open/close control routine, an opening degree of the flow control valve depending on an integrated flow rate of the cooling water.

4. The cooling device for the internal combustion engine according to claim 1, wherein the control device completes the open/close control routine and shifts to perform an opening-degree control in which the opening degree of the flow control valve is controlled based on the outflow temperature, when a condition that the information about the change rate of the outflow temperature is equal to or lower than the specified value continues for a specified period or longer while the flow control valve is being opened.

5. The cooling device for the internal combustion engine according to claim 4, wherein the control device sets the specified period based on the flow rate of the cooling water.

* * * * *